US006715245B2

(12) United States Patent
Lewkowitz

(10) Patent No.: US 6,715,245 B2
(45) Date of Patent: Apr. 6, 2004

(54) IMPACT RESISTANT PANE AND MOUNTING

(75) Inventor: Bernd Lewkowitz, Margate, NJ (US)

(73) Assignee: Signature Door Co., Inc., Altoona, PA (US)

( * ) Notice: Subject to any disclaimer, the term of this patent is extended or adjusted under 35 U.S.C. 154(b) by 0 days.

(21) Appl. No.: 10/114,129

(22) Filed: Apr. 3, 2002

(65) Prior Publication Data

US 2003/0188498 A1 Oct. 9, 2003

(51) Int. Cl.[7] ..... E06B 3/00; E06B 3/70; E06B 3/964; E06B 3/30; E06B 7/00

(52) U.S. Cl. ..... 52/208; 52/204.53; 52/204.591; 52/204.62; 52/455

(58) Field of Search ..... 52/208, 204.53, 52/204.591, 455, 204.62

(56) References Cited

U.S. PATENT DOCUMENTS

| | | | | | |
|---|---|---|---|---|---|
| 2,356,878 | A | * | 8/1944 | Painter | 52/208 |
| 2,374,057 | A | * | 4/1945 | Watkins | 52/208 |
| 2,398,886 | A | * | 4/1946 | Drake | 52/208 |
| 2,567,353 | A | * | 9/1951 | Ryan | 52/208 |
| 2,576,392 | A | * | 11/1951 | Downes | 52/208 |
| 2,679,467 | A | * | 5/1954 | Sherts | 52/208 |
| 2,721,157 | A | * | 10/1955 | Martin | 52/208 |
| 2,848,761 | A | * | 8/1958 | Hahn | 52/208 |
| 3,358,409 | A | * | 12/1967 | MacKay | 52/208 |
| 4,274,242 | A | | 6/1981 | Linton et al. | |
| 4,550,540 | A | | 11/1985 | Thorn | |
| 4,615,155 | A | | 10/1986 | Chamberlain | |
| 5,007,217 | A | | 4/1991 | Glover et al. | |
| 5,245,809 | A | | 9/1993 | Harrington | |
| 5,544,454 | A | | 8/1996 | Richardson et al. | |
| 5,544,465 | A | | 8/1996 | Hood et al. | |
| 5,560,149 | A | | 10/1996 | Lafevre | |
| 5,577,363 | A | | 11/1996 | Tate et al. | |
| 5,644,874 | A | | 7/1997 | McKann | |
| 5,720,142 | A | | 2/1998 | Morrison | |
| 5,749,184 | A | | 5/1998 | McKann | |
| 5,765,325 | A | | 6/1998 | DeBlock | |
| 5,778,629 | A | | 7/1998 | Howes | |
| 5,784,853 | A | | 7/1998 | Hood et al. | |
| 5,802,783 | A | | 9/1998 | Bayha | |
| 5,937,611 | A | | 8/1999 | Howes | |
| 5,960,606 | A | | 10/1999 | Dlubak | |
| 5,983,593 | A | | 11/1999 | Carbary et al. | |
| 6,101,783 | A | | 8/2000 | Howes | |
| 6,151,849 | A | | 11/2000 | Twigg et al. | |
| 6,425,215 | B2 | * | 7/2002 | Farrar | 52/204.5 |
| 6,546,682 | B1 | | 4/2003 | DeBlock et al. | |

* cited by examiner

*Primary Examiner*—Brian E. Glessner
*Assistant Examiner*—Kevin McDermott
(74) *Attorney, Agent, or Firm*—Duane Morris LLP

(57) ABSTRACT

An impact resistant laminated glass and plastic pane is provided for a hurricane resistant door light or similar opening. A glass pane is attached to a flexible plastic sheet that protrudes beyond the peripheral edge of the glass, preferably as an extension of the plastic laminate between outer glass laminate sheets. The pane body is mounted in a building structural part such as a door or wall, at an opening or at a recess, whereby the surface of the structural part extends up to a point adjacent to the pane. The flexible sheet that is attached to the pane, laps over the surface adjacent to the edge of the structural part around the pane. An elongated molding element that preferably frames the opening, is attached to the structural part so as to capture the flexible sheet between the molding element and the surface.

5 Claims, 3 Drawing Sheets

FIG. 1
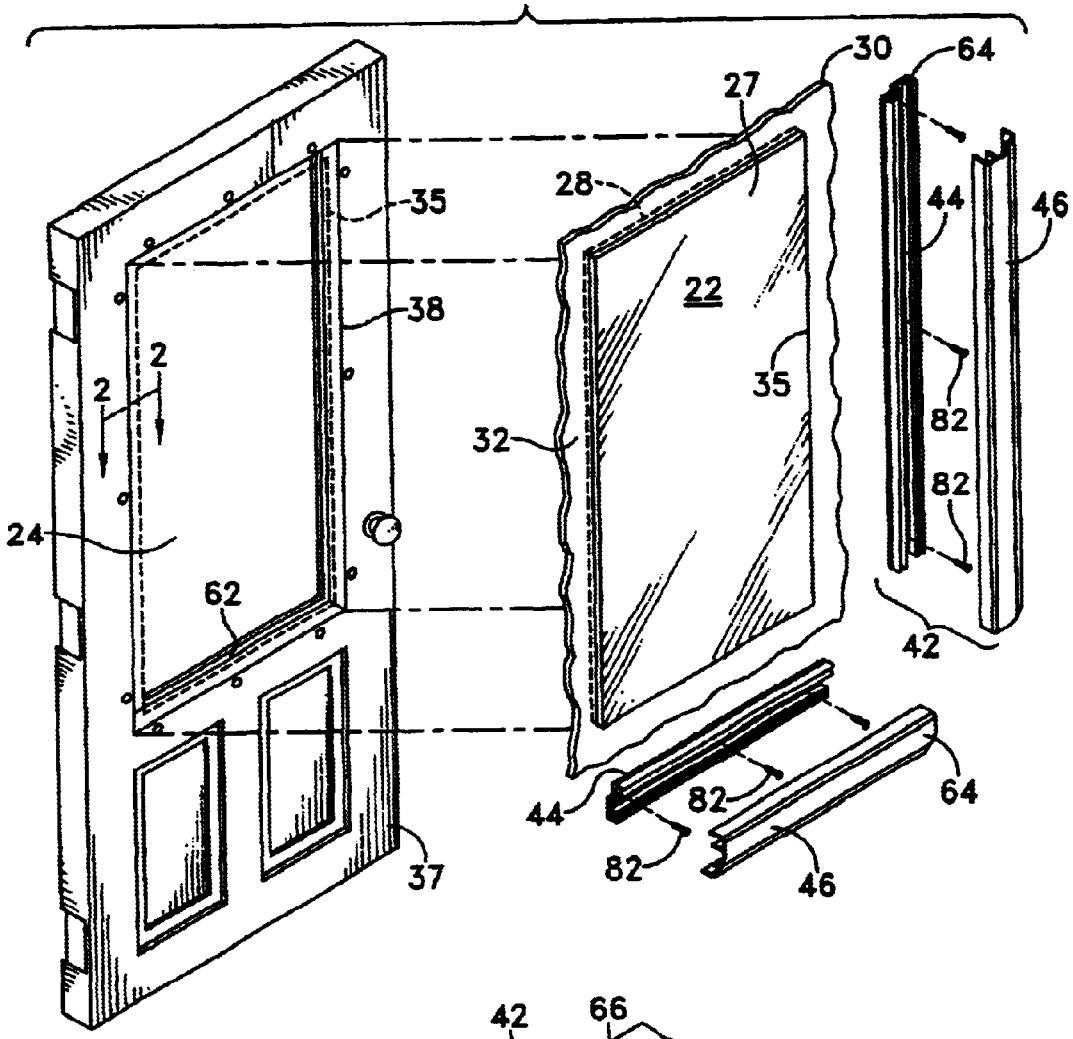
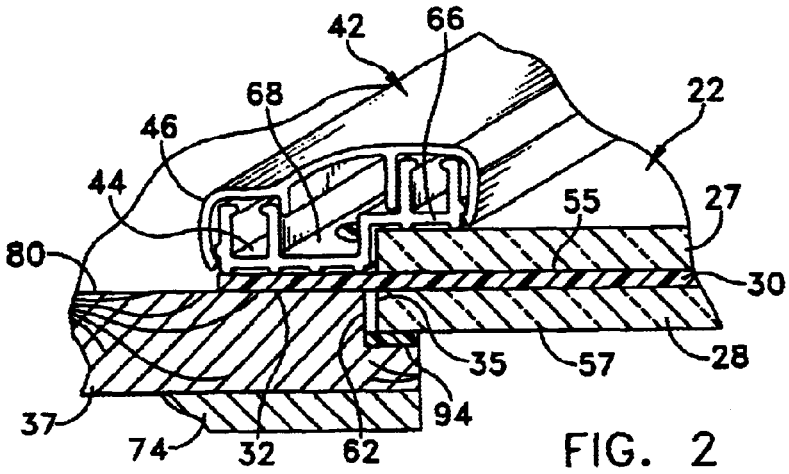
FIG. 2

IMPACT RESISTANT PANE AND MOUNTING

BACKGROUND OF THE INVENTION

1. Field of the Invention

The invention relates to the impact resistant structures for transparent, translucent and similar panes, for example in or around doors and windows.

According to the invention, a pane structure comprises a laminate with a flexible plastic sheet that protrudes beyond a rigid body, for example the flexible plastic center sheet of a glass-plastic-glass laminate. The protruding sheet of plastic remains in a plane and is spaced from one or both of the facing surfaces of the pane, e.g., by a thickness of glass. The pane fits in an inset in a wall or panel, which can be formed by a stepped cutout, or can be limited by an affixed molding or strip. The inset is substantially as deep as the spacing, such that the plastic sheet is positioned to protrude for a distance adjacent to the inset where the pane is fitted. The protruding plastic is coplanar with the integral portion of the plastic in the laminate and is clamped by molding elements to the surface adjacent to the inset. In this way the pane is rigidly fixed in the inset so long as the pane remains intact, is resiliently fixed in the opening in any event, and can be replaced readily if broken.

2. Prior Art

Efforts have been made for some years to improve the structural strength of elements of buildings, particularly in coastal areas and most particularly in the state of Florida after unexpectedly heavy damage was caused by a hurricane in 1992. Standards were developed for determining the merits of structures for withstanding damage in storms characterized by high winds, such as hurricanes and tornadoes. In such storms, wind pressure imposes static and also dynamic or cyclic loads on structures. Strong winds also entrain debris that may strike structures with considerable force.

An impact from fast moving debris can cause a structure such as a window or door to fail. Failure of a window or door potentially weakens the structure as a whole, and at least increases the likelihood of further damage by permitting wind, rain and possibly additional debris to enter the building. Conventional window glass is readily frangible (i.e., not tempered or laminated safety glass). Thus breaking the glass may leave an unobstructed opening.

After incidents of hurricane damage, more stringent building code standards were applied in coastal areas to deal with this danger. Among other requirements, windows, doors and other similar openings were required to be capable of surviving certain impacts without failing to the extent that the opening that they occupy becomes breached. Thus for example, the glass in a window or door might fracture and the window (etc.) could still meet the code, provided that the manner of breakage kept intact the envelope of the building structure.

Preventing any fracture of the glass might require glass that is very strong. Glass can be made strong enough even to be "bulletproof," but there are drawbacks. The glass might be very thick and aesthetically undesirable, noticeably refractive, less-than transparent, unduly heavy, expensive, etc. The code requirement to keep intact the building envelope in the event of impact is usually met instead by using laminated safety glass, similar to glass used in automobiles. The glass is a sandwich of frangible glass attached to a flexible plastic sheet. The glass can fracture but remains affixed to the flexible sheet. The flexible sheet and the pieces of glass that remain adhered to the plastic, maintain a barrier across the opening, even if the glass becomes fractured. The pane may have to be replaced if the glass fractures, but hurricanes and associate breakage are rare, so the cost/benefit mix is right.

The specific standards applicable in South Florida and other jurisdictions are different in different counties, but typically divide a building into zones of different elevation. At low elevation up to 10 m (30 ft) of building elevation, relatively large wind-borne debris might be expected, e.g., trashcans, lawn furniture, vegetation, fencing and building elements, etc. At higher elevation, smaller debris is more likely to be carried in a high wind, such as roof gravel or ballast. Either type of debris could easily break a window pane.

An exemplary standard for the "large missile zone," or low elevation zone, may require a door or window to survive test firing of a 4-kg, 0.06 m diameter×1.2 m timber (substantially equal to a 9-lb framing stud) endwise at the test specimen, at a missile speed of 15 m/s (55 km/h or 50 ft/sec or 35 mph). Each test specimen is struck twice, once in the center and once in a corner. After the large missile impact tests, which may fracture the glass as discussed above, the test specimens are subjected to an extended series of many positive and negative wind pressure cycles.

Door and window structures that can routinely survive such tests are available. Some are characterized by a transparent or translucent pane that is inherently strong enough to survive an impact and is mounted rigidly in a door or wall or other structurally sound panel via a rigid mounting structure that likewise can survive the impact. Others are laminates of materials and may have layers of glass and flexible plastic, metal or fibrous mesh reinforcement, etc.

U.S. Pat. No. 5,765,325—DeBlock teaches a multiple layer hurricane door light construction. (A door "light" refers to a light transmissive pane or window installation in an otherwise opaque door or entryway or similar structure.) In DeBlock, a polycarbonate sheet having peripheral screw holes is mounted between two glass panels and is spaced from each of the glass panels. The polycarbonate sheet is rigid and relatively clear, but is much less easily shattered than glass. The door light is mounted in an opening in a door frame by means of molding members that are screwed together to clamp the door between them, and according to this patent the screws are passed through the holes around the rigid polycarbonate sheet so as to improve the structural connection between the window pane structure and the door frame. If a missile breaks the glass, the polycarbonate is likely to remain intact.

The DeBlock door light construction is less easily breached than plain glass, but the polycarbonate sheet is not attached to the glass in the manner of safety glass and instead forms only a means for improving the mechanical connection with the door via the clamping moldings. The relatively hard plain glass spaced on either side of the polycarbonate sheet normally isolates and protects the softer polycarbonate against scratches. Thus the door light appears much like a familiar glass structure. However, the multiple spaced layers of glass and polycarbonate make the door light or window relatively thick and reminiscent of bulletproof glass. The polycarbonate sheet is structurally complicated by the need for pre-formed peripheral holes, which makes the construction somewhat complicated and expensive. Safety glass can be used in the outer glass panes, but if so the safety glass does not contribute structurally to the mounting of the door light, which relies on the opposed clamping moldings and the polycarbonate sheet.

Instead of, or in addition to making a door light or window pane very durable and similar to bulletproof glass in a heavy frame, the pane can be mounted in a manner intended to absorb impact stress. Even assuming the breakage of a frangible glass portion of the door light or window, the envelope that is defined by the window can be arranged to remain intact if a flexible barrier remains in place. A partly compliant mounting reduces shock on the glass during an impact, as compared to a very rigid mounting, and reduces the incidence of breakage.

U.S. Pat. Nos. 6,101,783, Howes and 5,560,149—Lefevre use resilient mounting techniques that might be considered similar to mounting a rigid pane against cushioned glazing pads placed at the perimeter of the pane. In U.S. Pat. No. 5,960,606—Dlubak, a very heavy pane is mounted rigidly in a channel forming structure and is faced with a floating pane that does not engage in the channel, and is similarly cushioned.

In U.S. Pat. Nos. 5,937,611 and 5,777,629, both to Howes, a flexible plastic sheet or membrane is laminated into a pane assembly, for example between two outer relatively-more-rigid sheets of glass or plastic, that sandwich the flexible membrane. The flexible membrane protrudes beyond the edges of the rigid sheets and is intended to contribute to the mechanical attachment of the pane assembly to the surrounding framing.

The protruding membrane, which is flexible, can be bent or folded as desired relative to the rigid glass. In Howes '629, a pane assembly with a protruding membrane is mounted in an opening that complements the rigid glass part. The flexible membrane is folded perpendicular to the plane of the glass pane. In a vertical window, for example, the plastic membrane on the top and bottom edges of the pane are folded into a horizontal plane and brought back toward the interior along the surface of the sill and along the underside of the header. The pane is caulked on both its inner and outer sides. A wood or vinyl frame or molding element is installed against the glass and over the protruding flexible membrane, by nails or screws or the like, extending through the molding and through the membrane, into the sill or header. The flexible membrane remains as a permanently incorporated member of the window assembly.

The same arrangements can be employed along the lateral sides of the pane as at the top and bottom. That is, the flexible membrane that protrudes laterally is brought back, perpendicular to the plane of the window pane, to reside along the inside surfaces of the side framing, where similar molding elements are attached over the membrane by fasteners extended through the molding and through the membrane into the side framing.

The membrane in the Howes '629 patent is intended to provide an attachment that is at least somewhat compliant, by physically mounting the rigid laminated pane to the window framing via the flexible plastic sheet that is sandwiched between the glass laminate sheets and is affixed to the framing.

However, there are some problems. Howes's structure of a plastic sheet extending outwardly in the plane of the glass is inconsistent with the need to form neat corners. The flexible membrane can be cut out at the each of the four corners, so that upper and lower flaps have vertical edges and opposite lateral side flaps have horizontal edges. Alternatively, the corners can be folded in an overlapped way, in the same way that a square package can be wrapped with flat wrapping paper. This can present problems.

One problem is that the plastic membrane does not bend easily and neatly. Bending the membrane neatly around 90 degrees all along an edge, particularly a long edge, is time consuming and needs to be done precisely. The right angle bend, as well as the flexing operations associated with achieving the bend, tend to weaken the film. If the pane is to be mounted simply in a through-opening, such as an opening in a wood or steel door body with frame or style parts having a rectangular cross section adjacent to the opening, it is necessary to resolve the problems of where the plastic film is to reside and how the plastic film is to attach structurally to the body of the door or the like, if the film is to be structurally attached at all.

A right angle folding method is possible as in Howes '629, but after folding the membrane, mounting the pane and affixing a molding to capture the protruding plastic membrane and engage the window frame, the structural connection in Howes '629 is possibly less than optimum. The plastic membrane is joined at a right angle to the glass sandwich, which is a stress point where the plastic may be sheared if the glass vibrates and is displaced. Panes as described are typically supplied with factory-attached frames, rather than installed at the site.

The plane of the portion of the plastic that protrudes and is folded back, according to the installation as described, perpendicular to the plane of the glass pane. Inward wind pressure on the window, which results in compression force in the plane of the flexible membrane, at least so long as the glass is intact, is not resisted. Only outward wind suction, which translates into tension in the plane of the affixed membrane, is resisted resiliently. It would be advantageous of these aspects could be improved.

The Howes '611 patent discloses a method for making a laminated assembly comprising two glass sheets sandwiched around a flexible sheet that protrudes beyond the perimeter of the glass. The teachings of Howes '611 are incorporated for such teachings. A first panel is laid on a flat surface. The flexible plastic sheet or membrane is laid over the pane, pulled taut, and taped to the flat surface. Double-faced adhesive tape spacers are applied around the edges and the second pane is laid atop the first pane, with the flexible sheet and the spacers in between. The other glass sheet is laid atop the flexible sheet and an adhesive is injected.

Howes '611 discloses an alternative structural embodiment (see FIG. 2), wherein one of two laminated glass panels is longer and/or wider than the other panel. The flexible membrane extends beyond the edge of the shorter panel, but only up to the edge of the longer/wider panel. In another embodiment (FIG. 4), the flexible membrane is diverted perpendicularly as discussed above, but this structure occurs within a frame component to provide an assembled framed window element to be mounted as a unit in a window sash, door light or the like.

An arrangement as in Howes '611 has structural benefits due to the particular modes of attachment and support between the glass and the frame structure, including the protruding flexible membrane. What is left for the designer or installer is only robustly to attach the frame component to the structural parts of a door or window frame. This is advantageous in that the installer is not required to attend to the protruding plastic membrane (which is attached to the frame component at the factory). But such a pre-manufactured frame is an expensive solution, and the entire frame must be replaced if the window is broken. It would be advantageous to provide an effective way to use a protruding membrane pane without requiring a whole pre-manufactured unit.

What is needed is an optimal impact-resistant structure, with "optimal" not only including ability to survive impact, but also including unit cost, replacement cost, ease of installation, attractiveness and the like. The mounting should provide a rigidly durable structural engagement for laminated panes of glass or other materials and also the resilient yet durable impact absorbing and resisting capabilities of a flexible sheet.

SUMMARY OF THE INVENTION

It is an object of the invention to provide a structure for mounting pane structures having protruding flexible membranes, whereby such pane structures can be employed without the need for special frame components.

It is another object to improve conventional pane mountings for window glass, safety glass and the like, to add an engagement structure for a resilient sheet associated with the glass.

It is a further object to provide a window structure with a complementary pane receptacle and an associated molding, wherein the molding is arranged to engage with a flexible sheet protruding beyond the pane receptacle.

It is also an object to achieve some of the advantages of pre-manufactured pane structures such as in the cited Howes patents, having flexible membranes pre-attached in frames, in a pane installation that is inexpensively and conveniently assembled at the site rather than supplied with a pre-attached frame.

These and other objects are provided by an impact resistant laminated glass and plastic pane according to the invention, for a hurricane resistant door light or similar opening. A glass pane is attached to a flexible plastic sheet that protrudes beyond the peripheral edge of the glass, preferably as an extension of the plastic laminate between outer glass laminate sheets. The pane body is mounted in a building structural part such as a door or wall, at an opening or at a recess, whereby the surface of the structural part extends up to a point adjacent to the pane. According to an inventive aspect, the flexible sheet that is attached to the pane, e.g., laminated into the pane body or otherwise attached and protruding, laps over the surface adjacent to the edge of the structural part around the pane. An elongated molding element that preferably frames the opening, is attached to the structural part so as to capture the flexible sheet between the molding element and the surface.

The structural part can be a door light opening, a window opening, a window sash, an entryway light, etc. The invention is applicable to a variety of situations and can be embodied in more or less durable and heavy ways as needed for particular sites. The structural part could be defined, for example, by a heavy solid body such as a steel door, or by a relatively lighter part such as a frame defined by a lattice of mullions. In the embodiments discussed in detail the invention is applied to the non-limiting example of a door light in an otherwise conventional hinged door.

The framed opening or mullions or the like defines a through opening or a recess. The pane is mounted in the opening at a sufficient depth to cause the flexible plastic sheet protruding from the edge of the pane to lay over a surface adjacent to the pane, over which the molding element extends. The molding element extends over the recess to mechanically clamp down on the pane, and also on the surface adjacent to the pane, thus clamping the flexible sheet against the surface. This clamping entails a force at least partly perpendicular to the plane of the pane.

In one arrangement, the protruding flexible plastic sheet is the continuous extension of the laminated plastic layer of safety glass, namely between two glass sheets attached on opposite sides of the plastic. Where just this glass-plastic-glass laminate constitutes the pane, the recess in the structural part for the pane can have a depth equal to the thickness of the inner (lower) layer of glass. This places the level of the flexible plastic at the same level as the surface of the structural part, adjacent to the opening. In such an embodiment with two glass layers at an inset, a molding element to capture both the glass and protruding plastic can have two levels defining a stepped surface. A lower or inner level clamps over the flexible plastic and attaches to the structural element by fasteners passing through the plastic. An upper one of the levels of the molding rests against the glass pane. Suitable spacers, seals and shock absorbing pads optionally can be placed between the parts.

In other embodiments the glass can have additional parts such as a spacer between glass and/or plastic layers to provide an air gap. Another embodiment discussed below comprises molding strips affixed from opposite sides of a straight through-opening, wherein a molding part attached from one side is dimensioned to form an inset of the required depth on the opposite side, clamping simultaneously the pane and the door structure adjacent to the through opening.

A preferred exemplary molding element comprises an aluminum extrusion and can have elongated grooves or lips to engage securely with the flexible plastic. On the laterally outer sides of the molding, catch lips are raised. A molding cover with inwardly facing catch structures snaps over the lips.

BRIEF DESCRIPTION OF THE DRAWINGS

These and other features and advantages of the invention will be more fully disclosed or rendered apparent from the following detailed description of certain preferred and/or exemplary embodiments of the invention, and the accompanying drawings, wherein like numbers refer to like parts. In the drawings:

FIG. 1 is an exploded perspective view generally illustrating the elements of the invention as applied to an exemplary door light.

FIG. 2 is an elevation view, partly in section, showing the assembled invention, the view being taken, for example, along line 2—2 in FIG. 1.

DETAILED DESCRIPTION OF THE PREFERRED EMBODIMENTS

Figure 3:
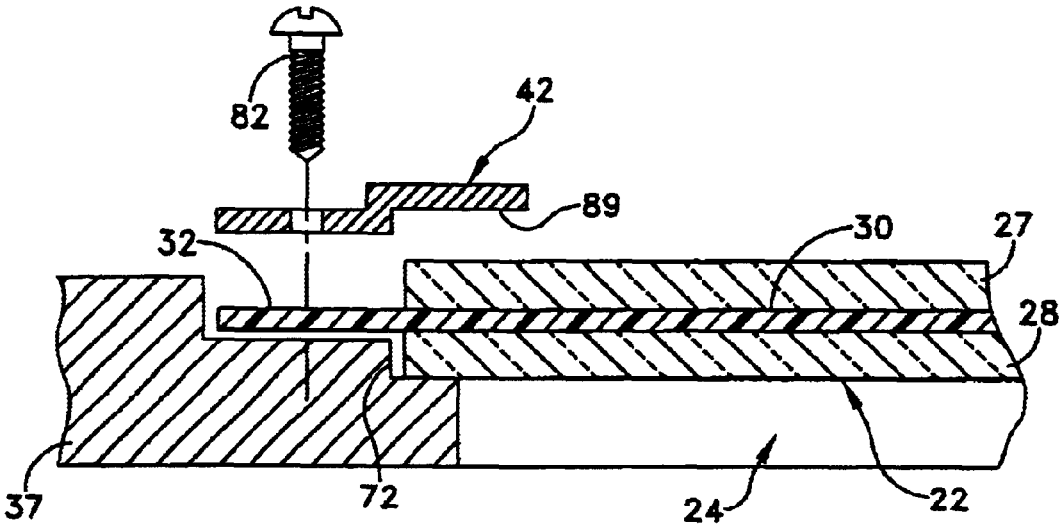
FIG. 3 is a section view corresponding to FIG. 2, but illustrating a simplified embodiment.

Throughout this description, the same reference numbers have been used to refer to the same or corresponding elements in the respective figures. Reference and relational designations such as "higher," "lower," "above," "below," "inside," "outside," etc., have been used as a matter of convenience to describe the subject matter of the drawing or embodiment under consideration. Such designations should not be construed to limit the invention to a particular orientation unless specifically described as necessary or critical.

Referring to FIGS. 1 and 2, an impact resistant laminated glass and plastic pane 22 is shown for mounting in a hurricane resistant or intruder-resistant door light 24. The invention is also applicable to other mountings for panes, such as fixed and movable windows and sashes, sliding doors, fixed frames or mullions such as entryways, garage door glass, etc. In each case the invention is intended to improve the barrier against entry, whether due to airborne debris, deliberate pounding with tool or otherwise.

A pane 22 comprising glass is preferred as an example of a frangible material normally apt for use in windows, but is subject to fracturing and according to the invention is mounted in a resilient manner so as to maintain an envelope or barrier across the opening. The pane 22 can comprise other materials, such as polycarbonate instead of or in addition to glass. The pane can be translucent or opaque instead of clear. It can be a composite or mosaic, etc. The invention is particularly useful where the pane 22 is at least faced with a hard but fracturable material such as clear glass. The point is to provide a structure that maintains a continuous or substantially continuous barrier across the door light or other opening 24 if the fracturable part becomes broken. This counters possible debris damage in a storm, or possible unauthorized entry by a person with a tool attempting to break and enter.

The pane 22 normally has two sheets of glass 27, 28, spaced by a flexible plastic sheet 30 that is disposed between the sheets 27, 28 of glass and preferably is adhered to both sheets. This structure is characteristic of safety glass. The plastic laminate sheet or layer 30 can be a conventional safety glass flexible laminate material, for example, plasticized polyvinyl chloride, polyvinyl butyral, ethylene/vinyl acetate or another suitable flexible layer that adheres to glass laminate layers 27 and/or 28, inherently or with the aid of an adhesive or an intervening resin layer or a crosslinking agent such as a silane.

According to an inventive aspect, this flexible plastic layer 30 is structured so as to protrude or extend outwardly beyond the edge of the glass sheets 27, 28 of the laminated pane 22. This leaves a strip 32 of flexible plastic beyond the edge 35 of the frangible part of the pane, which strip 32 is flexible and provides a means whereby the pane 22 is coupled resiliently with the structural part 37, such as a hinging door body, that contains the opening 24. In this way, the pane 22 can be mechanically mounted in a rigid manner in opening 24 by suitable structures that engage around the edge of the pane 22, and also mounted resiliently, by coupling the flexible plastic to the structural part 37 around the edges of the opening 24.

Preferably the invention employs a multilayer structure and can contain a laminate of glass-plastic-glass, wherein the plastic 30 is adhered on both sides to adjacent glass layers 27, 28. A three layer laminate of glass and plastic is also possible wherein the plastic 30 is adhered to one glass layer 27 or 28 and simply abutted against the other without adherence. Both examples are shown, for example in U.S. Pat. No. 5,937,611—Howes, which is hereby incorporated for such teachings. Alternatively, a two layer laminate can be employed wherein a flexible plastic layer 30 is adhered to one side of a single sheet 27 of glass or the like. As shown by an embodiment discussed below, the pane can have additional layers, air gaps, etc.

In any event, the pane structure, e.g., of a glass and plastic laminate, is mounted such that a protruding strip 32 of the flexible plastic layer 30 is disposed on the surface 38 of the supporting structural part 37 (e.g., the door body or an associated molding or the like) adjacent to the framed through-opening, indentation or similar opening 24 that holds the pane 22. In the example shown, the plastic edge strip 32 is simply an integral extension of the plastic laminate 30 adhered between inner and outer glass laminate sheets 27, 28 that face the pane 22 on opposite sides.

Figure 4:
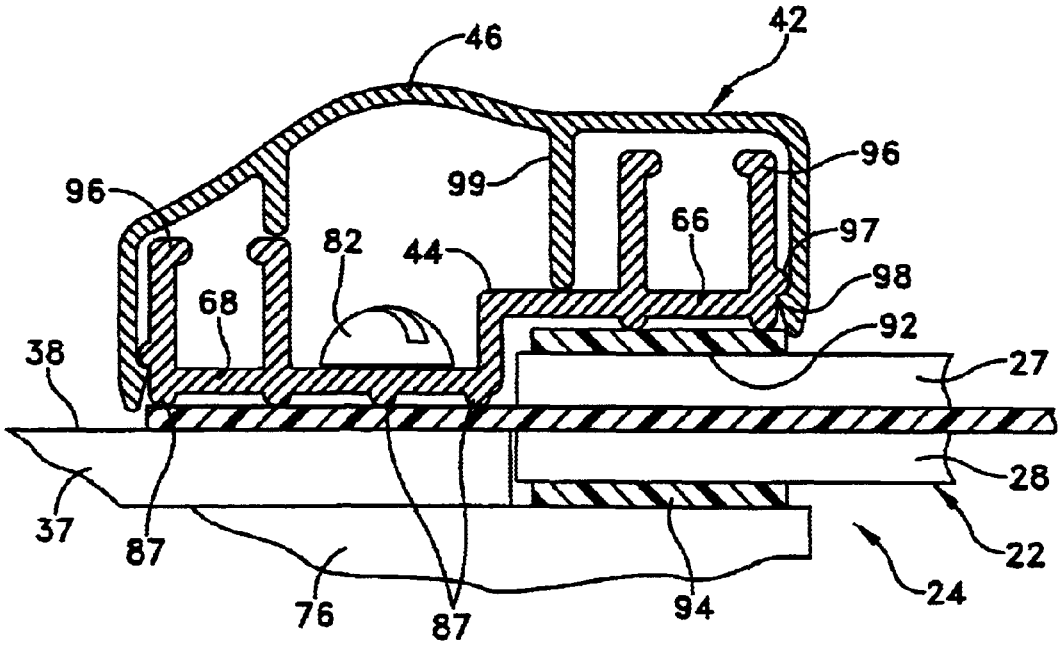
FIG. 4 is a detailed section view showing the structure of a preferred molding and snap-on cover.

The pane 22, comprising two sheets 27, 28 of glass adhered to a sandwiched plastic sheet 30 in the embodiment shown in FIGS. 1 and 2, and including the flexible protruding plastic strip 32, is mounted in a building structural part such as a door or wall, at an opening or at a recess 24. The pane 22 is fitted into an opening or recess 24 of a dimension that corresponds in shape and area to the glass part of pane 22 only. The opening or recess 24 has a depth that is only sufficient to locate the plane of the sandwiched plastic sheet against the surface 38 of the structural part 37 (e.g., door). That is, the glass part of pane 22 extends laterally out to abut the edges of the opening 24, or at most to have minimal clearance. FIG. 1 shows the assembly in an exploded view. FIG. 2 shows a detail of the embodiment of FIG. 1, as assembled. FIGS. 3 and 4 illustrate further details as well as some alternative arrangements.

According to an inventive aspect, the flexible sheet 30 that is attached to the rigid body of pane 22, e.g., being laminated between spaced glass sheets comprised in the pane body or otherwise attached and protruding, extends laterally out beyond the edges of the opening 24. The plastic sheet 30 laps over the surface 38 of the door or other structural part 37 carrying the pane 22, for a short distance adjacent to the edge of the opening 24 for the pane 22. An elongated molding element 42 that can be part of a decorative frame for the pane 22 and opening 24, is attached to the door or other structural part 37 so as to capture the flexible sheet 30 between the molding element 42 and the surface 38 adjacent to the opening 24 for the pane 22.

In the preferred embodiment shown, the molding element 42, in combination with an indented or inset structure of the door, holds the frangible pane 22 mechanically in place in the opening 24, rigidly so long as the pane is intact. The molding element resiliently captures the protruding strip 32 of plastic 30, between the molding element 42 and the door or other structure 37. The molding element 42 generally comprises a base part 44 that is affixed to the door or other structure 37 containing the opening 24, and a covering part 46 that attaches to the base part 44. The molding element 42 bears against the outer glass surface 55 of the pane 22 (optionally with a seal or gasket as shown in FIG. 4), holding the inner glass surface 57 against the surface of an inset rabbet or cutout 62 around the perimeter of the opening 24 in the door 37.

If the glass layers 27, 28 of the pane are fractured, the flexible plastic sheet 30 thereafter provides a flexible barrier across the opening 24, affixed by molding element 42 to the door or other structural part 37. In the embodiment wherein the glass of the pane 22 is adhered to the flexible sheet 30, the opening is kept intact while also holding a substantial part of the frangible glass in place, in the form of fractured pieces (not shown) affixed to the plastic 30.

The molding element can be of varying widths but preferably is wide enough and/or is contoured on the surface bearing against the plastic sheet, to securely hold the plastic sheet to the door or similar structure in all expected circumstances. If the glass is broken and a load is applied to the broken glass structure, it can be expected that the plastic may stretch, but preferably the edges of the plastic remain affixed to the door or the like.

In the normally preferred arrangement, the flexible sheet 30 is provided at one of the internal layers of a laminate that comprises glass or similar hard-wearing outer layers 27, 28. As a result of this structure, the plane occupied by the flexible sheet 30 in the laminate is spaced inwardly from both opposite faces of pane 22. According to an aspect of the invention, a pane 22 as described with a flexible sheet 30 at an intermediate point in a laminate is mounted at an inset having a supporting surface that is spaced back from the surface by an amount that brings the flexible sheet 30 coplanar with the surface 38 adjacent to the mounting opening 24. For example, in an embodiment wherein the pane 22 consists of a flexible plastic sheet between two equal thicknesses of glass 27, 28, the pane 22 can be mounted in an opening 24 bordered by a rabbet or step-wise inset 62 that is precisely as deep as the inner one 28 of the glass layers. The elongated molding likewise has a stepwise configuration that permits part of the molding to rest against the outer glass layer 27 and part to rest on and capture the flexible strip 32. Thus the flexible sheet 30, including the protruding strip 32 thereof, remain coplanar in the assembled state of the pane structure, without preliminary deformation or stretching or folding of the plastic and with corresponding benefits in structural strength as well as ease of assembly and replacement.

This structure of two glass thicknesses with an intermediate flexible layer to rest on surface 38 adjacent opening 24, is such that the inset or rabbet 62, which is only as deep as the inner glass layer 28 is thick, places the flexible plastic sheet 32 flush with surface 38, but also causes the outer-facing glass layer 27 to remain above a level flush with surface 38. The bordering elongated molding element 42 accommodates this fact.

The bordering molding element that captures plastic strip 32 also clamps the rigid glass pane 22 at a level higher than surface 38. Preferably, molding element 42 is formed of one or more aluminum extrusions, with a complementary step-wise shape on its side facing the pane 22. On the opposite or outer-facing side, the molding element 42 can have a structure that either reflects or masks the stepped shape on its opposite side facing the pane. In a preferred embodiment, the molding element has a base portion 44 that is stepped, and a cover portion 46 that is shaped to mask the difference in level by means of a rounded outer crown shape as shown in FIGS. 2 and 4.

The invention is generally directed to an impact resistant installation for a pane 22 such as a safety glass laminate, by providing for simultaneous rigid mechanical mounting of the pane and flexibly compliant mounting by capture of the protruding strip 32 of plastic 30. The invention is applicable to an opening 24 such as the hinge-carried body of a door as shown in FIG. 1, or any other similarly structured location for a rigid pane structure. Examples (not shown) include an entryway panel or light laterally adjacent to a doorway, a transom over a doorway, a window in a wall panel, etc. The installation comprises a pane or panel 22 that is typically transparent, translucent or similarly transmissive of light, but could also be opaque, such as a simulated stone or the like. In any event, the pane part comprises a laminate having a generally planar pane body 22 of relatively less flexible material, or in the case of glass, frangible material 27, 28, affixed to a flexible sheet 30. Thus, for example, in an alternative embodiment the pane could be made of two layers of another material such as wood, sandwiching a flexible sheet that protrudes and is captured around the periphery as shown.

The flexible sheet 30 protrudes at least at a portion such as s strip 32 around a periphery of the frangible material of the pane body 22, substantially in a plane parallel with that of the pane body. The invention is applicable to a situation in which the flexible sheet 30 protrudes on only certain edges, but preferably the flexible sheet 30 protrudes all around the edges of the pane body as shown in FIG. 1. The extent of such protrusion from the pane body is subject to some variation, and in the illustrated embodiment is about 0.75 inch (2 cm).

In FIG. 1, the pane is mounted to a structural part 37 in the form of a hinged door body. The embodiments of FIGS. 2–4 are generalized to any pane-mounting, such as a window, entryway, door, skylight, etc. The structural part 37 has an outer surface 38 on at least one side, around the perimeter of the opening 24 that receives the pane 22. The rigid or body part of the pane 22 is disposed to extend up to a point adjacent to the edge of this opening 24. The flexible sheet 30, which protrudes from the edges of the rigid pane body, laps over the edges of the opening 24 and rests on the surface 38 of the structural part 37 adjacent to the periphery of the pane 22.

Preferably the pane rigid body part fits into the opening 24 in the structural part 37 with a minimal clearance, e.g., only sufficient to permit some flexing of the structural part without breaking the normally frangible glass part of the pane 22. Some clearance also facilitates ease of installation, but the clearance is normally less than about 0.25 inch (5 mm). The flexible sheet must extend by more than that clearance distance in order to protrude over the surface surrounding the perimeter of the pane opening. Thus the flexible strip is at least 0.25 inch (5 mm) wide and in the preferred arrangement is somewhat wider to provide a reasonably wide area to engage under the molding element 42. In the embodiment shown, the strip 32 has a width that is approximately equal to the width of the molding 42 outside of the opening 24, although it would be possible for the outer part of the molding to be wider than the protruding strip 32 of plastic 30.

According to the invention, the protruding strip or edge 32 of the flexible sheet 30 is located on and is clamped against the surface 38 of the structural part 37 around the perimeter of the opening 24. The integrity of the clamping is in part due to the nature of the clamping elements, discussed in more detail below, and is in part due to the width of the strip that is clamped. As mentioned, the clamping area of strip 32 need not be the same as the available width of the molding element 42, although that is possible. In a pane 22 of a size typically encountered in a door light or the like, a clamping width of 0.75 inch (2 cm) is typically sufficient to achieve a good mechanical engagement, particularly in conjunction with longitudinal ribs as shown in FIGS. 2 and 4 to securely engage the molding element with the strip 32. A wider strip is possible to achieve a more secure structural connection or to achieve an equal structural connection in the absence of ribs. The strip itself also can be more or less vigorously attached to the door body 37, for example by providing more or fewer fasteners per unit of clamping area.

Conversely, a narrower strip 32 may be appropriate for a given set of demands. Preferably, assuming minimal clearance between the edge of the pane and the perimeter of the pane (nominally zero clearance), the flexible sheet can extend outwardly from the edge of the opening, over the surface of the structural part adjacent to the opening, by 0.2 to 2.0 inches (5 mm to 5 cm). The preferred arrangement encompasses a strip 32 with 0.75 inches of clamping area outside of the opening 24, and uses a molding element 42 that clamps over all of the area of the strip.

A preferred elongated molding element that is affixed to the structural part 37 around the perimeter of the pane body 22, is shown in FIGS. 1, 2 and 4. FIG. 3 shows an alternative. Preferably, and as shown in FIG. 1, the elongated molding part 42 is arranged to frame all around the pane body 22 along the surface 38 adjacent to the periphery of the pane part 22, e.g., with mitered corners 64. The molding element 42 is attachable to the structural part 37 by screws or other fasteners that are extended through the molding element 42, through the strip 32 and into the structural part 37, so as to capture and clamp the flexible sheet 32 between the molding element 42 and the surface 38 adjacent to the periphery of the pane body 22. This provides a resilient structural connection between the pane and the structural part (e.g., the hinging body of the door) as described, that can survive at least a certain range of impacts, even if the pane 22 is fractured or if other mechanical means mounting the pane (not shown apart from the elongated molding) should fail.

Figure 5:
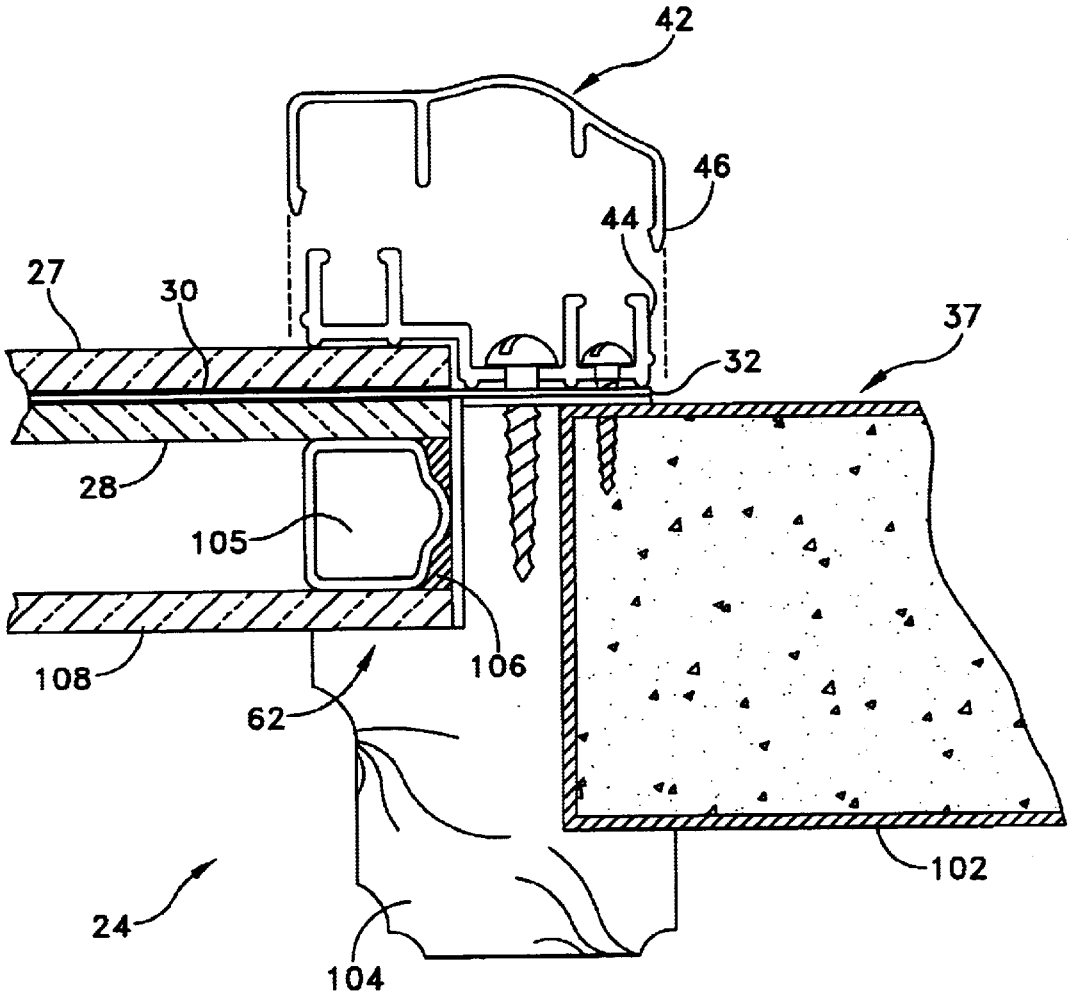
FIG. 5 is a partial section view illustrating an alternative embodiment of the invention, having a door body with a straight through opening.

FIG. 5 shows an alternative in which the invention is applied to a steel door with a straight-through opening for the pane. The invention is particularly applicable to a steel door arrangement because a steel door is difficult to shape with insets around four sides of the pane opening and normally requires more attention for fastening (e.g., pre-drilling, etc.) than is typical of a wood or plastic door body.

In FIG. 5, the door body 102 can be, for example, a 24 gauge steel shell with a urethane foam core. The opening for the pane is not stepped and as shown in cross-section is limited to two right angle edges (this cross section occurs substantially in the same way around the four edges of the pane). According to this embodiment, a step-forming molding part 104 is inserted from one side of the opening and defines the inset for the pane. The molding part 104 can comprise vinyl, wood, aluminum, a composite material or the like.

The pane in this embodiment comprises two glass layers sandwiched on a flexible sheet, but these two layers are also affixed via a spacer 105 and a seal 106 to a third glass layer 108, leaving a gap that can be filled with air or an inert gas, for thermal insulation or radiation shielding purposes. In a preferred arrangement, the flexible sheet is durable polyethylene terephthalate (PET) adhered between glass layers 27 by a resin. The spacer 105 and seal 106 comprise aluminum and butyl rubber, respectively, and a silicone cushion/seal layer is provided at least on the outer facing glass surfaces.

A silicone cushion can also be applied over and/or under the protruding plastic layer engaged under the clamping molding element 42 or, more particularly, engaged under the base part 44 thereof. As described above, a fastening screw is placed to hold the molding element 42 against the step forming molding element 106. Advantageously but optionally, a second screw can affix the molding element to the steel door body. This second screw is not strictly necessary because the steel door body is clamped between the molding element 42 and the flanged edge of the step forming molding element 106 on the opposite side of the door body. But the second fastener is preferred. In this arrangement, the flexible sheet not only holds the pane relative to the step forming molding element, but also seals the structure to the steel door body and structurally attaches the flexible sheet to the steel door body as well.

In the embodiments shown in cross section in FIGS. 2, 3 and 4, the pane 22 comprises a laminate with inner and outer layers 27, 28 sandwiching the intermediate flexible part 30. In FIG. 2, the structural part is shown as wood, the outer pane layers 27, 28 are glass and the inner laminate layer 30 is flexible plastic. This structural is characteristic of safety glass, but is intended as exemplary rather than limiting. Preferably, one or both of the glass layers 27, 28 is adhered to the plastic sheet 30 such that the glass remains adhered if broken. Provided the structural connection of the plastic strip 32 with the structural part 37 around the surface 38 remains intact, the window enclosure will not fail even if the glass in the pane is broken.

In the embodiment shown in FIG. 2, the pane comprises two layers 27, 28 of glass sandwiched on opposite sides of the flexible sheet, and the inner and outer glass layers are of equal or approximately equal thickness. In FIG. 3, the inner layer 28 is of a somewhat greater thickness than the outer layer 27. In both embodiments, the structural part 37 to which the pane body 22 is mounted has an inset or rabbet 62 of a depth substantially equal to the thickness of the inner one 28 of the pane layers, e.g., the inner layer of glass as shown. As a result, the protruding strip 32 of the flexible sheet 30 lays directly on the surface of the structural part, and is substantially coplanar with the portion of the flexible sheet 30 that is sandwiched between the glass layers 27, 28.

The elongated molding element 42 is stepped so as to present an inward facing surface at two levels or elevations. One of the levels, namely the laterally inner higher level 66, bears against the outer surface pane body 22, clamping the opposite outer surfaces of the pane body 22 between the molding element 42 and the bottom of the stepped rabbet or cutout 62. The second level presented by the molding 42 is laterally outside and at a lower level corresponding to the surface 38 of the structural part 37. That second and lower level 68 clamps the strip 32 of flexible sheet 30 to the surface 38 of the structural part 37.

It is normally preferable to include a hard wearing pane on the exposed surface of the window, namely of glass rather than a facing sheet of flexible material. Thus the outer laminate layer 27 of the pane 22 defines a thickness or elevation that is higher than the surface of the structural part. It is also possible to provide plural stepped levels 72 as shown in FIG. 3, whereby the strip 32 of flexible sheet 30 is clamped to the structural part 37 at a stepped level lower than the highest level of the structural part at the surface around the pane mounting.

As described, namely wherein the pane 22 has two layers 27, 28 of glass sandwiched on opposite sides of the flexible sheet 30, and the structural part 37 to which the pane body is mounted has an inset of a depth substantially equal to a thickness of one of said layers of glass, the level that captures the flexible sheet being relatively lower than the level that rests against the pane body. FIG. 3 shows a plural-step opening 72. FIG. 2 shows an embodiment in which there is an inside molding 74 as well as the outside molding 42 that clamps the strip 32 of the flexible sheet 30. FIG. 4 illustrates yet another embodiment wherein the inside bearing structure is provided by a distinct inner layer 76 of the structural part, such as an inner layer of a multilayer door structure or an inside molding part that is used for structural support, instead of or in addition to a decorative inner molding as in FIG. 2.

The elongated molding element 42 that clamps the flexible strip 32 is attached to the structural part 37 by fasteners, such as screws 82 as shown in FIGS. 1, 3 and 4. As shown in FIGS. 1 and 2, the elongated molding 42 is preferably elongated substantially continuously along the edges of the pane body 22. However the molding element 42 could also comprise a number of shorter lengths that provide a number of spaced points at which the strip 32 of the flexible sheet is clamped to the structural part. As another possible embodiment, the molding can have a discontinuous base portion 44, made of a number of short lengths, and a continuous cover strip 46.

In the embodiment of FIGS. 1, 2 and 4, the elongated molding comprises a continuous base portion 44 that serves as the part that clamps the flexible strip 32 to the surface 38, and a detachable cover strip 46 snaps onto the base portion 44 of the molding element. FIG. 2 shows that the cover 46 is likewise elongated. The base portion 44 and the cover strip 46 preferably are made as integral aluminum extrusions. The base portion has a plurality of elongated ridges 87 on the side facing the door surfaces, which provide a rank of spaced lines at which points are defined where the flexible material is nipped between the molding 42 and the surface 38 of the structural part 37.

If the pane should be broken by an impact, the frangible glass laminate layers 27, 28 are fractured into pieces, some of which remain attached to the flexible sheet 30. In part, however, the flexible sheet 30 is thereby freed to bow inwardly and outwardly. Such bowing exerts tension on the flexible sheet 30 and clamped strip 32. The clamping of the protruding strip 32 of flexible sheet 30 at the multiple nip points of the base portion 44 of the elongated molding 42 tends to share the tension thus applied to the full area of the protruding strip 32 of flexible sheet. As a result, the envelope defined by the window is relatively resistant to failure, even though the glass part of the structure can be fractured by impact from a suitable striking tool or article of wind borne debris.

Referring to FIG. 3, a minimal structure for the molding element is a bi-level strip 89 that is affixed to the structural part at its peripheral outer and lower level 68, and engages over the pane 22 on the peripherally inner and higher level 67. A preferred structure is shown in FIG. 5, wherein the underside of base 44 has elongated nip-forming ridges 87 for bearing against the flexible sheet 30, and additional such ridges extending over the portion that bears against the pane, for engaging against a seal strip or gasket 92 on the outside of the pane 22. Another similar gasket 94 can be disposed on the opposite or inner side of the pane as shown. Such gaskets cushion the pane and reduce the possibility of shattering of the glass layers 27, 28.

In the base part 44 of the molding, a channel area is provided adjacent on the lower level adjacent to the step between the levels, for the head of a fastener such as a screw 82 that extends through a bore in the base part 44 and is threaded into the body of the door or other structure 37. Two pairs of standing ridges 96 are paired at the opposite edges of the base part 44 and tend to substantially stiffen and strengthen the base part. On the outermost and innermost of the standing ridges 96, locking ridges 97 extend outward for engagement in a snap-over manner with the complementary ridges 98 of the molding covering strip 46.

In addition to having lateral sides that skirt over the base part 44, the covering strip 46 also has standing ridges 99 whose ends rest against the base portion 44. In the embodiment shown, for example, one of the integral standing ridges 99 on the covering strip 46 rests against the bottom of the base portion 44 and the other rests against the top of one of the standing ridges 96 of the base portion 44. The respective ridges provided on both the base portion and the covering strip stiffen their respective structures, and their interaction helps to guide the covering strip onto the base portion such that they can only be brought together in a way in which they will snap together in correct alignment.

The invention has been described with reference to certain preferred embodiments and examples, including the example specifically illustrated in the drawings. It should be understood that the invention is not limited to the examples shown in the drawings, and instead is defined by the appended claims. Reference should be made to the following claims rather than the foregoing examples, to assess the scope of the invention in which exclusive rights are claimed.

What is claimed is:

1. An impact resistant installation comprising:

a pane having a generally planar pane body of frangible material affixed to a flexible sheet, the pane comprising two coextensive layers of glass, sandwiched on opposite sides of the flexible sheet, wherein the flexible sheet protrudes outwardly in a plane from between the layers of glass at least around a portion of a periphery of the pane body, substantially in a plane parallel to the pane body;

a structural part defining an opening for receiving and supporting the pane body, a stepped edge being provided around the opening with a surface parallel to the pane body, wherein the opening is dimensioned to receive the pane against a bottom of the stepped edge at an inset of a depth substantially equal to a thickness of one of said two layers of glass that lies against the bottom of the stepped edge, the other of said two layers of glass residing above the inset, thereby supporting the pane in the structural part with the flexible sheet extending outwardly over the surface adjacent to the opening; and, an elongated molding element arranged to frame the pane body along the surface adjacent to the periphery, wherein the molding element is attachable to the structural part so as to capture the flexible sheet between the molding element and the surface adjacent to the periphery of the pane body.

2. The installation of claim 1, wherein the molding element has two levels defining a stepped surface wherein one of the levels rests against the pane body and another of the levels captures the flexible sheet against the surface adjacent to the periphery of the pane body.

3. An impact resistant installation comprising:

a pane having a generally planar pane body of frangible material affixed to a flexible sheet, wherein the flexible sheet protrudes from at least a portion of a periphery of the pane body, substantially in a plane parallel to the pane body;

a structural part to which the pane body is mounted, the structural part having a surface adjacent to the periphery of the pane body, over which the flexible sheet is disposed;

an elongated molding element arranged to frame the pane body along the surface adjacent to the periphery, wherein the molding element is attachable to the structural part so as to capture the flexible sheet between the molding element and the surface adjacent to the periphery of the pane body;

wherein the molding element has two levels defining a stepped surface wherein one of the levels rests against the pane body and another of the levels captures the flexible sheet against the surface adjacent to the periphery of the pane body;

wherein the pane comprises two layers of glass sandwiched on opposite sides of the flexible sheet, and wherein the structural part to which the pane body is mounted has an inset of a depth substantially equal to a thickness of one of said layers of glass, the level that captures the flexible sheet being lower than the level that rests against the pane body; and, wherein the molding element is attached to the structural part by fasteners, and further comprising a detachable cover strip that snaps onto the molding element.

4. An impact resistant mounting for a safety glass pane, comprising:

a pane body with two parallel glass layers sandwiched around a plastic flexible sheet, wherein the glass layers are coextensive and the flexible sheet protrudes beyond a peripheral edge of the glass layers;

a structural part to which the pane body is mounted, the structural part having an opening, a stepped edge being provided in the opening, sized to receive the glass layers, wherein the stepped edge is as deep as one of said two glass layers that is disposed against a bottom of the stepped edge, the structural part having a surface adjacent to the periphery of the pane body, at which the flexible sheet protruding from between the glass layers lies flat against the surface where the flexible sheet protrudes beyond the peripheral edge of the glass layers; and, an elongated molding element arranged to frame the pane body along the surface adjacent to the periphery, wherein the molding element is attachable to the structural part so as to capture the flexible sheet between the molding element and the surface adjacent to the periphery of the pane body, and wherein the molding element has a stepped edge facing toward the pane body, the stepped edge of the molding element having a bottom facing toward the pane body, as deep as an other of said two glass layers and bearing toward the glass layers, the molding element having a part lying against the flexible sheet above the surface of the panel, thereby mechanically holding the glass layers between the stepped edges of the structural part and the molding, and holding the flexible sheet between the molding and the panel adjacent to the opening.

5. An impact resistant mounting for a safety glass pane having a pane body with two glass layers sandwiched around a plastic flexible sheet, the flexible sheet protruding beyond a peripheral edge of the glass layers, comprising:

a structural part to which the pane body is mounted, the structural part having a surface adjacent to the periphery of the pane body, over which the flexible sheet is disposed;

an elongated molding element arranged to frame the pane body along the surface adjacent to the periphery, wherein the molding element is attachable to the structural part so as to capture the flexible sheet between the molding element and the surface adjacent to the periphery of the pane body;

wherein the structural part defines a recess and the molding element extends over the recess to mechanically hold the pane;

wherein the molding element has two levels defining a stepped surface wherein one of the levels rests against the pane body and another of the levels captures the flexible sheet against the surface adjacent to the periphery of the pane body;

wherein the pane comprises two layers of glass sandwiched on opposite sides of the flexible sheet, and wherein the structural part to which the pane body is mounted has an inset of a death substantially equal to a thickness of one of said layers of glass, the level that captures the flexible sheet being lower than the level that rests against the pane body; and, wherein the molding element is attached to the structural part by fasteners, and further comprising a detachable cover strip that snaps onto the molding element.

* * * * *